US009644332B1

(12) United States Patent
Smith

(10) Patent No.: US 9,644,332 B1
(45) Date of Patent: May 9, 2017

(54) MODULAR BARRIER AND AIRFIELD REPAIR SYSTEM

(71) Applicant: Michael J. Smith, New Baltimore, MI (US)

(72) Inventor: Michael J. Smith, New Baltimore, MI (US)

( * ) Notice: Subject to any disclaimer, the term of this patent is extended or adjusted under 35 U.S.C. 154(b) by 0 days.

(21) Appl. No.: 15/130,958

(22) Filed: Apr. 16, 2016

(51) Int. Cl.
*E01F 13/00* (2006.01)
*E01F 15/08* (2006.01)
*E01C 5/06* (2006.01)

(52) U.S. Cl.
CPC ..... *E01F 15/083* (2013.01); *E01C 5/06* (2013.01); *E01F 13/00* (2013.01)

(58) Field of Classification Search
CPC ..... E01F 13/00; E01F 15/083; E01C 5/06
USPC ..... 404/6, 17, 36
See application file for complete search history.

(56) References Cited

U.S. PATENT DOCUMENTS 2,338,785 A 1/1944 Sommerfeld
3,377,931 A 4/1968 Hilton
4,690,583 A * 9/1987 Faulconer ..... E01D 19/103 404/12
6,782,624 B2 8/2004 Marsh
7,144,186 B1 12/2006 Nolte
7,571,577 B2 8/2009 Nanayakkara
8,590,439 B2 11/2013 White
8,888,399 B2 11/2014 Redlberger
9,010,228 B2 4/2015 White
9,038,332 B1 5/2015 Littlestone
9,057,165 B2 6/2015 Sagy
9,187,869 B2 11/2015 Rainey
2009/0235814 A1 9/2009 Cashin
2014/0053475 A1* 2/2014 Siqueiros ..... E01C 23/10 52/125.1
2014/0353565 A1 12/2014 Ditta
2015/0308791 A1 10/2015 Navarra

* cited by examiner

*Primary Examiner* — Raymond W Addie
(74) *Attorney, Agent, or Firm* — QuickPatents, LLC; Kevin Prince

(57) ABSTRACT

A combination traffic barrier and roadway repair system for use on a traffic way, such as a roadway, runway, taxiway or the like, includes an elongated base and an elongated rectangular slab. The base configured to support the rectangular slab in a vertical orientation when used as a barrier. The rectangular slab being detachable from said base and configured to be placed flush with a traffic way surface, thereby forming a portion of the traffic way.

19 Claims, 3 Drawing Sheets

MODULAR BARRIER AND AIRFIELD REPAIR SYSTEM

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to airfield repair, and more particularly to a combination traffic barrier and airfield repair system.

DISCUSSION OF RELATED ART

Portable traffic barricade systems are known in the art, and are typically adapted to be placed by truck or crane in a series of abutting barricades to quickly protect a jobsite or other sensitive area, or simply to direct traffic. However, even though such barricades are made from concrete, prior art barricades are not well suited to aid in roadway or runway repair, which often requires a large, flat slab of uniform thickness.

Therefore, there is a need for a system that can double as both a traffic barricade and a roadway or runway repair aid. Such a needed invention would provide means for securing a plurality of such barricades together to form an elongated connected barricade. Such a needed system would further provide aircraft tie-down anchors in the event of use as a runway repair aid. The present invention accomplishes these objectives.

SUMMARY OF THE INVENTION

The present device is a combination traffic barrier and roadway repair system for use on a roadway, such as an automotive road, bicycle road, airplane runway, taxiway or tarmac, bridge, or the like. An elongated base comprises a top surface, a bottom surface, a rear surface, a front surface, and two opposing side surfaces. The top surface includes a groove formed therethrough and traversing the base between both opposing side surfaces.

An elongated rectangular slab comprises a top surface, a bottom surface, a substantially flat front surface and opposing substantially flat rear surface, and two opposing side surfaces. The slab is preferably a rectangular solid and is adapted for upright placement within the groove of the base. The base holds the slab upright while stored therein, and provides a relatively tight clearance so that the slab does not have significant room to tilt back and forth while contained within the base.

In use, with the elongated base resting on the roadway or nearby, and with the slab placed upright within the groove of the base in a first operative position, the system provides a traffic barrier that significantly inhibits breach thereof by vehicles or pedestrians. In the event of roadway damage, such as in the case of war or sabotage, the roadway may be relatively quickly prepared to receive the slab with the front surface facing upward and flush with the roadway so that normal traffic operations may quickly resume. In such a case, the base remains as a partial traffic barricade while the slab is used as a quick roadway or runway repair patch.

To facilitate such moving of the base and the slab, either preferably include a plurality of anchors embedded at least partially therewithin and suitable for use with crane hooks or the like. Further, the anchors are preferably adapted for use as aircraft tie-downs as well.

The present invention is a system that can double as both a traffic barricade and as a roadway or runway repair aid. The present invention provides means for securing a plurality of such barricades together to form an elongated connected barricade, and further provides aircraft tie-down anchors in the event of its use as a runway repair aid. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
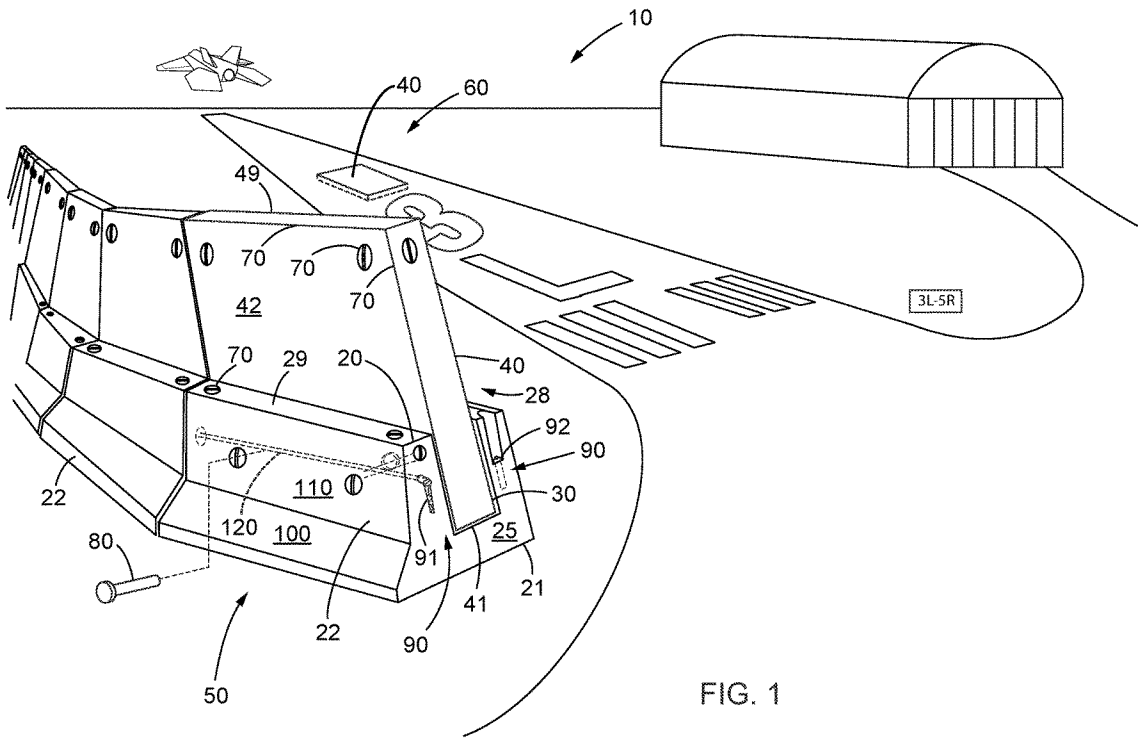
FIG. 1 is a perspective view of the invention, illustrating a combination traffic barrier and roadway repair system used in a traffic barrier first operative position and a roadway repair second operative position.
Figure 2:
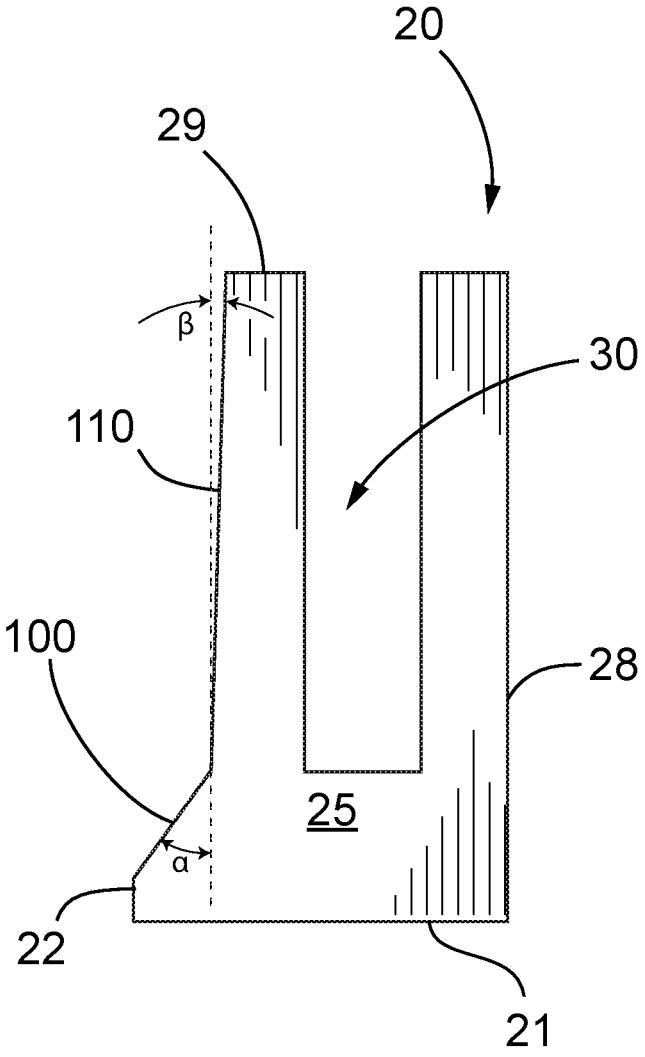
FIG. 2 is a side elevational view of a base of the invention.
Figure 3:
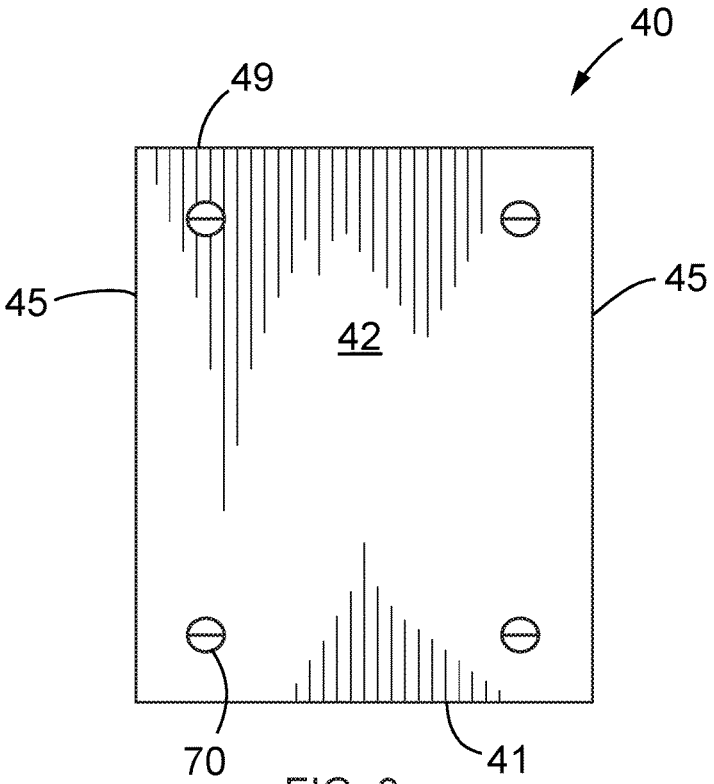
FIG. 3 is a front elevational view of a slab of the invention.

FIGS. 1-3 illustrate a combination traffic barrier and roadway repair system 10 for use on a roadway 15, such as an automotive road, bicycle road, airplane runway, taxiway or tarmac, bridge, or the like.

An elongated base 20 comprises a top surface 29, a bottom surface 21, a rear surface 28, a front surface 22, and two opposing side surfaces 25. The top surface 29 includes a groove 30 formed therethrough and traversing the base 20 between both opposing side surfaces 25. The groove 30 is preferably uniform such that the cross-sectional shape of the groove 30 is consistent from one side surface 25 to the opposing side surface 25.

Preferably the front surface 22 of the base 20 includes at least a first angled surface 100, having an angle α of between 40 and 60-degrees with respect to vertical. Another second angled surface 110 may be included, having an angle β of between 1 and 10-degrees with respect to vertical. As such, the bottom surface 21 is larger in plan view than the top surface 29 of the base, giving the base 20 greater tilt stability on the roadway 15. Further, such angled surfaces 100,110 allow at least a portion of impact forces from vehicles or the like to be deflected upwards, maintaining the base 20 on the roadway 15 and inhibiting breach of the traffic barrier formed thereby.

Figure 4:
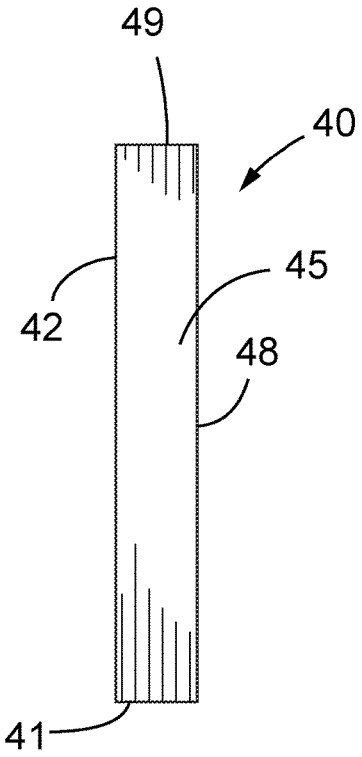
FIG. 4 is a top plan view of the slab.
Figure 5:
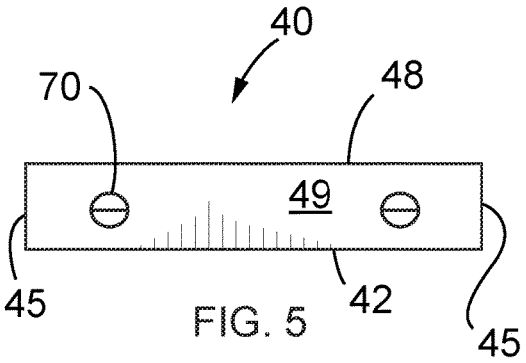
FIG. 5 is a side elevational view of the slab.

An elongated rectangular slab 40 comprises a top surface 49, a bottom surface 41, a substantially flat front surface 42 and opposing substantially flat rear surface 48, and two opposing side surfaces 45 (FIGS. 3-5). The slab 40 is preferably a rectangular solid and is adapted for upright placement within the groove 30 of the base 20. The base 20 holds the slab 40 upright while stored therein, and provides a relatively tight clearance so that the slab 40 does not have significant room to tilt back and forth while contained within the base 20. Gravity firmly holds the slab 40 within the base 20, and the base 20 is adapted to have a large enough bottom surface 21 so as to inhibit tipping of the base 20 and slab 40 even if experiencing a significant impact force or wind or weather force.

In use, with the elongated base 20 resting on the roadway 15 or nearby, and with the slab 40 placed upright within the groove 30 of the base 20 in a first operative position 50 (FIG. 1), the system 10 provides a traffic barrier that significantly inhibits breach thereof by vehicles or pedestrians. In the event of roadway damage 15, such as in the case of war or sabotage, the roadway 15 may be relatively quickly prepared to receive the slab 40 with the front surface 42 facing upward and flush with the roadway 15 (FIG. 1) so that normal traffic operations may quickly resume. In such a case, the base 20 remains as a partial traffic barricade while the slab 40 is used as a quick roadway or runway repair patch.

The base 20 is preferably made of concrete, reinforced concrete, composite material, relatively strong plastic or rubber material that is able to withstand relatively high compression force, or the like. The slab 40 is preferably made of concrete, reinforced concrete, heat resistant concrete or the like suitable for a class A traffic area (UFC 3-260-02). As such, moving either the base 20 or the slab 40 requires a heavy vehicle with craning capabilities. To facilitate such moving of the base 20 and the slab 40, either preferably include a plurality of anchors 70 embedded at least partially therewithin and suitable for use with crane hooks or the like. Further, the anchors 70 are preferably adapted for use as aircraft tie-downs as well. Such anchors 70 are advantageously embedded in the top surface 29 and/or side surfaces 25 of the base 20, and the top surface 49, front surface 42, and/or side surfaces 45 of the slab 40.

In some embodiments, the slab 40 is mechanically fastenable with the elongated base 20 in the first operative position 50 with at least two mechanical fasteners 80, such as long stakes 80 that traverse apertures at least partially through the base 20 and slab 40 (FIG. 1). Further, some embodiments may include a two-part fastening system 90 comprising two parts 91,92 thereof, each part 91,92 fixed with adjacent side surfaces 25 of abutting bases 20. As such, a plurality of the bases 20 may be fastened together to form a multiple-base traffic barrier (FIG. 1). Optionally a metal cable or rod 120 may be fixed between parts 91,92 of the two-part fastening system 90 on opposing sides surfaces 25 of the base 20, thereby providing additional tensile strength between the side surfaces 25 and strengthening the multiple-base traffic barrier.

While a particular form of the invention has been illustrated and described, it will be apparent that various modifications can be made without departing from the spirit and scope of the invention. For example, the slab 40 may take other shapes than rectangular solid or disk shapes. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A combination traffic barrier and roadway repair system for use on a roadway, comprising:

an elongated base comprising a top surface, a bottom surface, a rear surface, a front surface, and two opposing side surfaces, the top surface including a groove formed therethrough and traversing the base between both opposing side surfaces; and an elongated rectangular slab comprising a top surface, a bottom surface, two opposing substantially flat front and rear surfaces, and two opposing side surfaces, the slab adapted for upright placement within the groove of the elongated base;

whereby with the elongated base resting on the roadway and with the slab placed upright within the groove of the base in a first operative position, the system provides a traffic barrier, and the slab placed flat within a prepared recess in a damaged roadway in a second operative position, the slab provides at least a portion of a flat roadway repair.

2. The combination traffic barrier and roadway repair system of claim 1 wherein the elongated base includes at least a pair of anchors embedded partially within the elongated base.

3. The combination traffic barrier and roadway repair system of claim 2 wherein at least one of the anchors is embedded partially within the top surface of the elongated base.

4. The combination traffic barrier and roadway repair system of claim 2 wherein at least one of the anchors is embedded partially within one of the side surfaces of the elongated base.

5. The combination traffic barrier and roadway repair system of claim 1 wherein the slab includes at least a pair of anchors embedded partially within the slab.

6. The combination traffic barrier and roadway repair system of claim 5 wherein at least one of the anchors is embedded partially within the top surface of the slab.

7. The combination traffic barrier and roadway repair system of claim 5 wherein at least one of the anchors is embedded partially within one of the front surface of the slab.

8. The combination traffic barrier and roadway repair system of claim 5 wherein at least one of the anchors is embedded partially within one of the side surfaces of the slab.

9. The combination traffic barrier and roadway repair system of claim 1 wherein the slab is mechanically fastenable with the elongated base in the first operative position.

10. The combination traffic barrier and roadway repair system of claim 9 wherein the slab is mechanically fastenable with the elongated base with at least two mechanical fasteners.

11. The combination traffic barrier and roadway repair system of claim 1 wherein each side surface of the elongated base includes one part of a two-part fastening system, whereby a plurality of the bases may be fastened together to form a multiple-base traffic barrier.

12. The combination traffic barrier and roadway repair system of claim 1 wherein the front surface of the elongated barrier includes at least one angled surface.

13. The combination traffic barrier and roadway repair system of claim 12 wherein the at least one angled surface is angled at between 40 and 60-degrees with respect to vertical.

14. The combination traffic barrier and roadway repair system of claim 12 wherein the at least one angled surface is angled at between 1 and 10-degrees with respect to vertical.

15. The combination traffic barrier and roadway repair system of claim 1 wherein the front surface of the elongated barrier includes a first angled surface and a second angled surface.

16. The combination traffic barrier and roadway repair system of claim 15 wherein the first angled surface is angled at between 40 and 60-degrees with respect to vertical, and wherein the second angled surface is angled at between 1 and 10-degrees with respect to vertical.

17. The combination traffic barrier and roadway repair system of claim 11 wherein the one part of a two-part fastening system of each side surface is mutually connected with a cable traversing the elongated base.

18. The combination traffic barrier and roadway repair system of claim 1 wherein the slab is made with a heat resistant concrete material suitable for class A traffic loads.

19. The combination traffic barrier and roadway repair system of claim 1 wherein the roadway is an aircraft runway.

* * * * *